United States Patent [19]

Gee

[11] 4,217,876

[45] Aug. 19, 1980

[54] HEATER

[76] Inventor: James W. Gee, P.O. Box 1476, Cleveland, Tenn. 37311

[21] Appl. No.: 870,564

[22] Filed: Jan. 18, 1978

[51] Int. Cl.[3] ..... F24H 3/00

[52] U.S. Cl. ..... 126/99 R

[58] Field of Search ..... 126/99 R

[56] References Cited

U.S. PATENT DOCUMENTS

| | | | |
|---|---|---|---|
| 491,628 | 2/1893 | Yeoman | 126/99 R |
| 1,609,213 | 11/1926 | Smith | 126/99 R |
| 1,813,013 | 7/1931 | Baker | 126/99 R |
| 1,915,132 | 6/1933 | Langford et al. | 126/99 R |

*Primary Examiner*—Samuel Scott
*Assistant Examiner*—Wesley S. Ratliff, Jr.
*Attorney, Agent, or Firm*—Clarence A. O'Brien; Harvey B. Jacobson

[57] ABSTRACT

A firebox is provided having an end panel, opposite side panels and top and bottom panels, one end of the firebox being open. The firebox includes depending support legs and an outer housing including opposite side and end walls and a top wall is telescoped downwardly over the firebox with the front wall thereof sealingly secured across the open end of the firebox and the other end wall, the top wall and opposite side walls spaced outwardly from the end panel, top panel and opposite side walls, respectively, of the firebox. The lower marginal edges of the opposite side and end walls of the housing are generally horizontally registered with the lower ends of the legs and the firebox includes a grate spaced above the bottom panel. A fuel door opening is provided in the front wall above the grate and a draft door opening is provided in the front wall below the grate and above the bottom panel. A flue outlet pipe opens outwardly from the firebox above the grate and through one of the walls of the housing other than the front wall thereof. The housing includes heating air inlet and outlet structure opening thereinto and outwardly therefrom, respectively, and air pump structure is provided for causing heating air to pass into the housing through the heating air inlet structure, about the firebox within the housing and outwardly from the housing through the heating air outlet structure.

3 Claims, 5 Drawing Figures

HEATER

BACKGROUND OF THE INVENTION

Various forms of room heaters designed to burn solid fuel as well as liquid fuels have been heretofore provided. However, most room heaters are inefficient inasmuch as a major portion of the heat generated therein is exhausted therefrom through the flue of the heater. Further, the exterior surfaces of many room heaters are heated to high temperatures sufficient to cause combustion of combustible materials coming into contact therewith. In addition, such high heated exterior surfaces of some existing room heaters may cause serious burns to persons whose skin comes in contact with the exteriors of such heaters.

Various forms of room heaters as well as other heating devices including some of the general structural and operational features of the instant invention are disclosed in U.S. Pat. Nos. 3,636, 13,717, 1,277,519, 1,334,827 and 2,159,156.

BRIEF DESCRIPTION OF THE INVENTION

The room heater of the instant invention is constructed in a manner whereby a majority of the heat generated thereby will be utilized to heat the room in which the heater is disposed with a minimum amount of heat generated thereby passing outwardly from the heater through the flue pipe thereof.

The heater is also constructed in a manner whereby the exterior surfaces thereof will be maintained relatively cool so as to reduce the possibility of fire in the event combustible materials come into contact with the exterior surfaces of the heater and to also substantially prevent persons experiencing burns should their skin come in contact with the exterior surfaces of the heater.

The main object of this invention is to provide a heater which will be very efficient in operation.

Another object of this invention is to provide a heater including a thermostatic control for the draft air door and heating air circulating fan thereof.

Still another object of this invention is to provide a heater which may be utilized within a room in positions spaced from all walls of the room.

Yet another object of this invention is to provide a room air heater constructed in a manner whereby the exterior surfaces thereof will be maintained at lower temperatures than those usually associated with room heaters.

Another important object of this invention is to provide a room heater operative to pre-warm heating air to be pumped therethrough for heating purposes.

A final object of this invention to be specifically enumerated herein is to provide a room heater in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
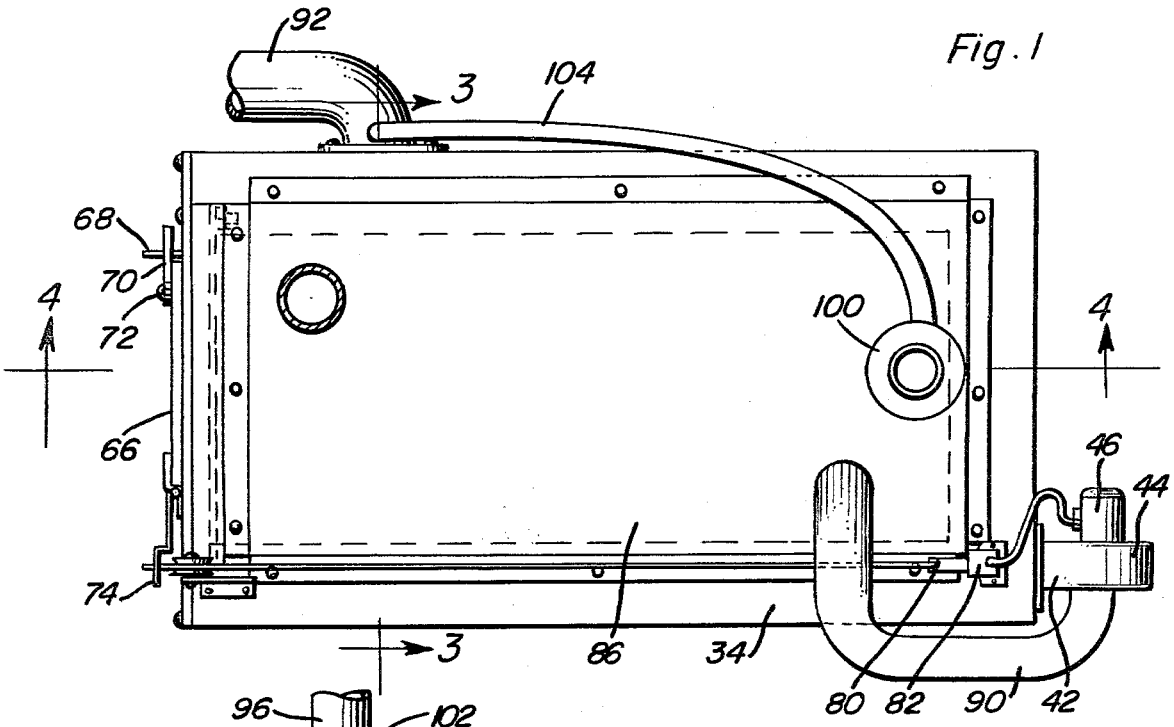
FIG. 1 is a top plan view of a heater constructed in accordance with the present invention.

Referring now more specifically to the drawings, the numeral 10 generally designates the heater of the instant invention. The heater 10 includes a firebox referred to in general by the reference numeral 12 and the firebox 12 includes opposite side panels 14 and 16, an end panel 18 and top and bottom panels 20 and 22 extending between and interconnecting the panels 14, 16 and 18.

The heater 10 further includes a downwardly opening hollow outer housing referred to in general by the reference numeral 24 and the housing 24 is composed of opposite end walls 26 and 28, opposite side walls 30 and 32 and a top wall 34 extending between and interconnecting the walls 26, 28, 30 and 32.

The firebox 12 includes four depending corner legs 36 for support of the firebox 12 in elevated position above a horizontal surface 38 upon which the legs 36 rest and the rear wall 28 has a heating air inlet opening 40 formed therein to which the outlet 42 of a squirrel cage-type blower 44 is operably connected, the blower 44 being powered by an electric motor 46.

The front of the firebox 12 is open and the dimensions of the housing 24 are such that the opposite side walls 30 and 32 are spaced outwardly of the opposite side panels 14 and 16, the end wall 28 is spaced outwardly of the end panel 18 and the top wall 34 is spaced above the top panel 20. Further, the forward marginal edges of the panels 14, 16, 20 and 22 are secured by fasteners 48 to inner peripheral portions of the front wall 26, the latter being secured to the forward marginal edges of the walls 30, 32 and 34 by means of fasteners 50. Of course, any suitable fireproof gaskets may be used between the front end of the firebox 12 and the inner surface of the front wall 26 and also between the forward marginal edges of the walls 30, 32 and 34 and the front wall 26.

The interior of the firebox 12 includes support strips 52 secured along the inner surfaces of the opposite side walls 14 and 16 thereof approximately six inches above the bottom panel 22 and a plurality of longitudinally extending grate bars are secured to a pair of spaced transverse support strips 56 whose opposite ends are supported from the strips 52. Thus, the bars 54 form a fire grate within the lower portion of the firebox 12. The front wall 26 includes a draft air opening 58 below the grate bars 54 and a draft door 60 is hingedly supported from the front wall 26 as at 62 and substantially fully covers the draft air opening 58 when the door 60 is in a fully closed position. However, the upper marginal edge of the draft door 60 is spaced slightly below the upper marginal edge of the opening 58 as a safety factor. Also, the front wall 26 includes a fuel access door opening 64 formed therein and a closure door 66 is hingedly supported from the front wall 26 and may be swung into and out of closed position relative to the opening 64, the closure door 66 may be provided with any suitable form of sealing structure for forming a heat-proof seal with the portions of the front wall 26 defining the opening 64. Also, the front wall 26 includes a latch retainer 68 and a latch handle 70 is pivotally supported from the door 66 as at 72 and may be utilized in conjunction with the retainer 68 to releasably secure the door 66 in a closed position.

Figure 2:
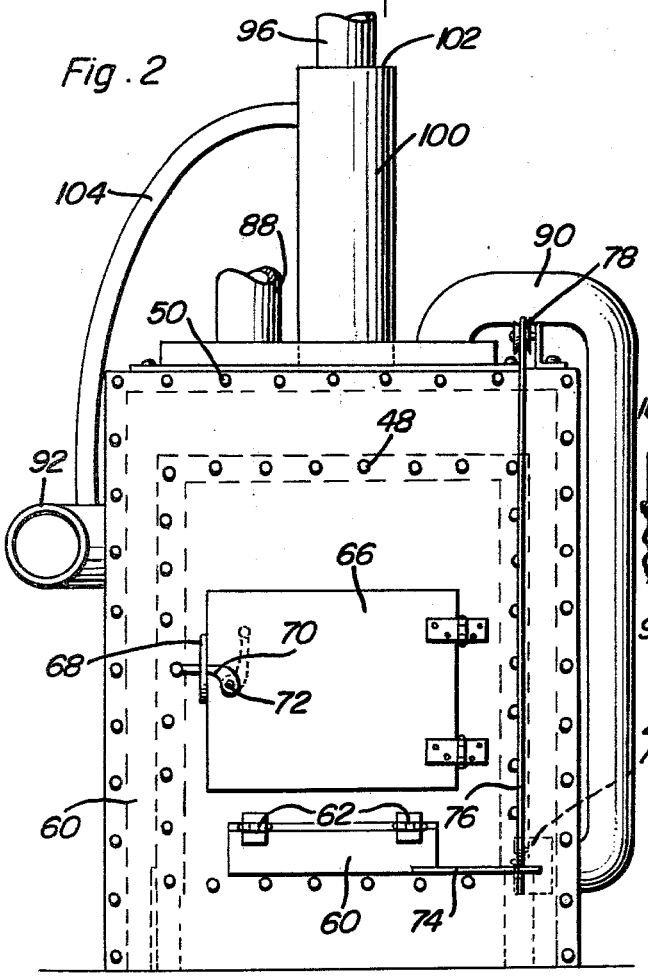
FIG. 2 is a front elevational view of the heater.
Figure 3:
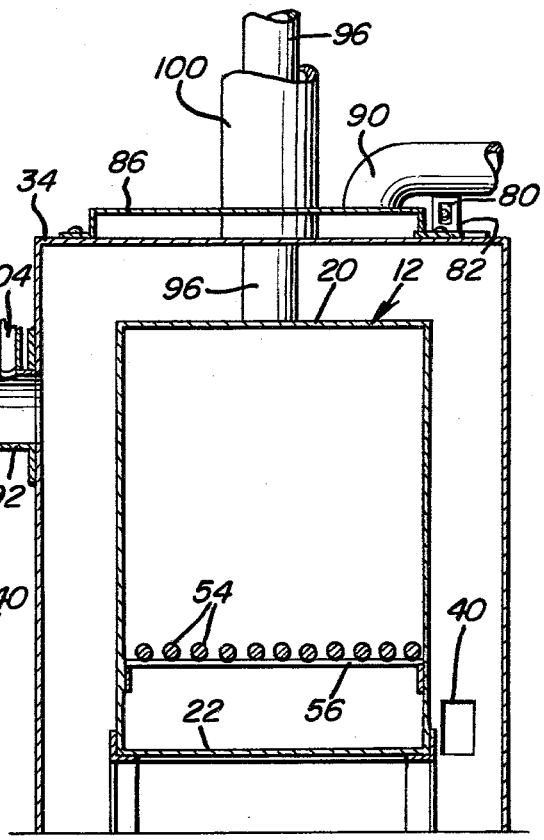
FIG. 3 is a transverse, vertical, sectional view taken substantially upon the plane indicated by the section line 3—3 of FIG. 1.
Figure 4:
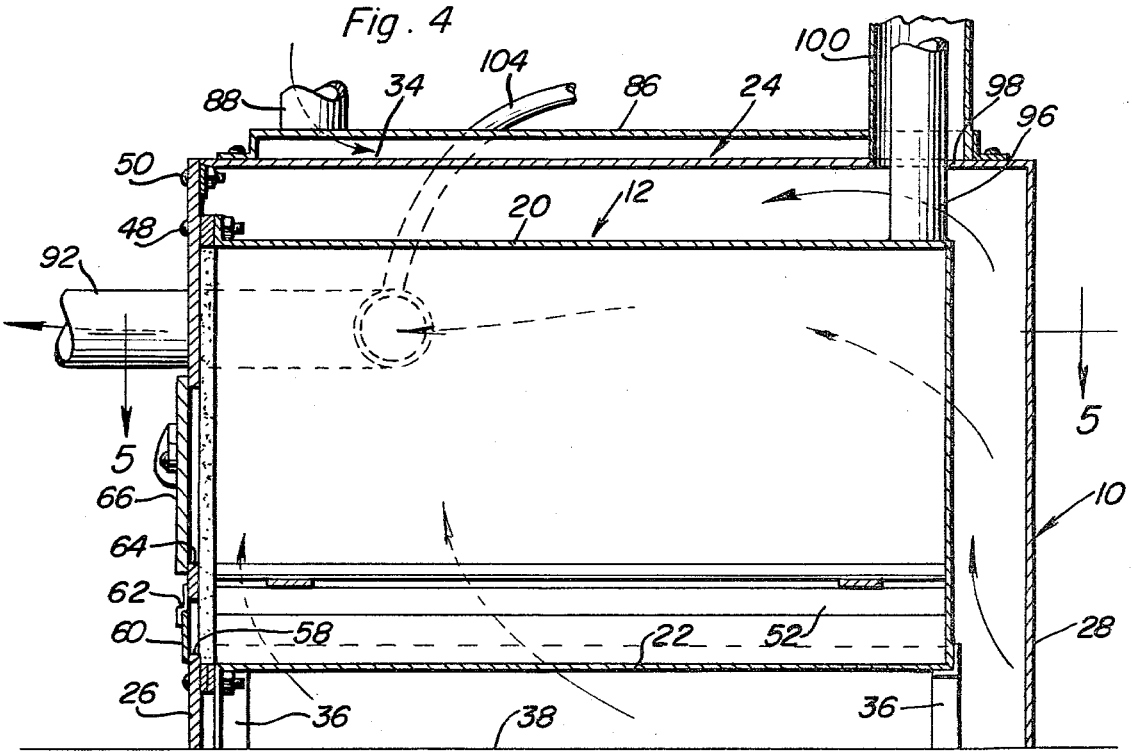
FIG. 4 is a longitudinal, vertical, sectional view taken substantially upon the plane indicated by the section line 4—4 of FIG. 1.
Figure 5:
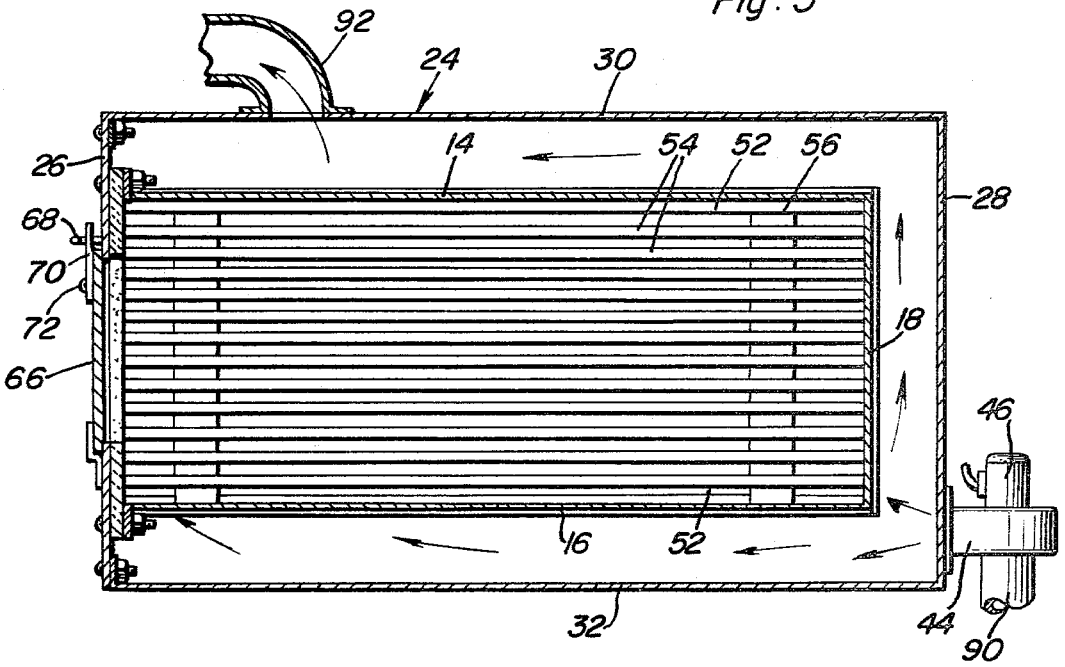
FIG. 5 is a horizontal, sectional view taken substantially upon the plane indicated by the section line 5—5 of FIG. 4.

The right side of the draft door 60, as viewed in FIG. 2 of the drawings, includes a horizontally outwardly projecting lever 74 to which one end of a cable 76 is attached and the cable 76 extends upwardly and is trained over a pulley wheel 78 journaled from and projecting forwardly of the forward marginal edge portion of the top wall 34. The end of the cable 76 remote from the door 60 is operatively connected to a solenoid 80 under the control of a thermostat 82, the thermostat also controlling the electric motor 46. Accordingly, the thermostat 82 is operative to initiate and terminate operation of the motor 46 and to also open and close the draft door 60.

The top wall 34 has downwardly opening pre-heating chamber 86 sealingly secured thereover and the pre-heating chamber 86 includes a heating air inlet 88 opening downwardly into the pre-heating air chamber 86. The inlet 88 opens downwardly through the front left hand corner of the pre-heating chamber 86 and the latter includes an air outlet duct 90 opening outwardly therefrom through the rear right hand corner portion thereof and which extends to the inlet of the blower 44.

The side wall 30 of the housing 24 includes a heating air outlet duct 92 and actuation of the blower motor 46 causes the blower 44 to draw air inwardly through the heating air inlet 88, through the pre-heating chamber 86, through the duct 90, into the blower 44 and to then be discharged into the housing 24 exteriorly of the firebox 12 for circulation thereabout and movement outwardly of the housing 24 by means of the conduit or duct 92.

The firebox 12 includes an upstanding flue outlet pipe 96 opening outwardly therefrom through the central rear portion of the top panel 20 and the flue outlet pipe 96 extends upwardly through an opening 98 formed in the top wall 34 and about which the lower end of a tubular manifold 100 is secured. The upper end of the tubular manifold 100 includes an upper closure wall 102 and the flue outlet pipe 96 projects upwardly through the closure wall 102 in sealed engagement therewith. Also, a bypass pipe 104 includes an inlet end opening into the upper end of the tubular manifold 100 and an outlet end opening into the inlet end of the duct or conduit 92.

Any suitable form of solid fuel may be burned within the firebox 12. Further, the firebox 12 may be modified to burn liquid or gaseous fuel, if desired.

Assuming that a fire has been started on the grate bars 54, the thermostat is actuated to open the draft door 60 and to effect actuation of the blower motor 46. Air from the room in which the heater 10 is disposed will be drawn into the heating air inlet 88, through the pre-heating chamber 86, through the pipe or conduit 90 and also through the blower 44 and the pre-heated air will then be discharged into the interior of the housing 24 exteriorly of the firebox 12 for circulation about the latter from both sides, the rear end and below. The heated air will then pass outwardly from the housing 24 through the conduit 92. Inasmuch as the blower 44 will be of sufficient capacity to maintain an above atmospheric pressure within the housing 24 about the firebox 12, a portion of the air blown into the housing 24 will pass upwardly into the tubular manifold 100 about the flue outlet pipe 96 and move about the latter in a cyclonic manner and then be discharged from the manifold 100 through the bypass pipe 104 and into the pipe or conduit 92 for subsequent discharging into the room to be heated.

Inasmuch as the pressure within the housing 24 exteriorly of the firebox 12 is above atmospheric pressure, the possibility of any flue gases from within the firebox 12 or the flue outlet pipe 96 contaminating the heating air is substantially eliminated. Also, the capacity of the blower 44 is such that a substantial portion of the heat of the firebox 12 will be absorbed by the air blowing through the housing 24 exteriorly of the firebox 12. Thus, the walls of the housing 24 will be maintained relatively cool and will thereby have little possibility of igniting flammable materials coming into contact therewith or burning skin coming in contact therewith.

It will also be noted that as a safety measure a metallic plate lined on its underside with insulative material may be placed upon the surface 38 and that the legs 36 of the firebox 12 may then be placed thereon with the lower marginal edges of the walls 26, 28, 30 and 32 of the housing 24 also contacting the outer periphery of the plate. In this manner, should there be an interruption in the supply of electrical current to the motor 46 during operation of the heater 10 sufficient heat may not build-up at the surface 38 to cause the latter to be ignited in the event the surface 38 is constructed of combustible materials.

Further, it is pointed out that the heater 10 may be provided with any suitable form of humidifier. Various forms of humidifiers suitable for operation in conjunction with hot air furnaces may be used on the heater 10. In addition, the top panel 20 of the firebox 12 of the heater 10 could be provided with a heat conductive and resistant pan into which water to be vaporized could be dripped at a controlled rate for substantially immediate flashing into water vapor. Thus, the heated air passing outwardly through the duct or pipe 92 may have its humidity appreciably increased.

The heater 10 may be used on the interior of a building to be heated thereby, or the heater may be disposed on the exterior of the building with the duct 92 leading to the interior of the building. In the latter instance, the inlet end of the air inlet 88 may also open into the interior of the building to be heated.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A heater including a firebox having an end panel, opposite side panels and top and bottom panels extending between said end and said opposite side panels with one end of said firebox being open, said firebox including depending support legs, an outer housing including opposite side and end walls and a top wall extending between said opposite side and end walls, said outer housing being downwardly telescoped over said firebox with one end wall sealingly secured over the open end of said firebox and said other end wall, top wall and opposite side walls spaced outwardly from said end panel, to panel and opposite side panels, respectively, and with the lower marginal edges of said opposite side and end walls generally horizontally registered with the lower ends of said legs, grate means in said firebox above said bottom panel, said front wall having a fuel door opening formed therein above said grate means and a draft door opening formed therein below said grate means and above said bottom panel, a flue outlet pipe opening outwardly from said firebox above said grate means and through one of said walls other than said front wall, said outer housing including heating air inlet and outlet means opening thereinto and outwardly therefrom, respectively, said flue outlet pipe opens upwardly through said top wall, said top wall having an opening formed therethrough upwardly through which said outlet pipe is loosely received, an upstanding tubular manifold having its lower end sealingly secured to said top wall about said top wall opening, the upper end of said tubular manifold including a closure wall upwardly through which said flue outlet pipe extends in sealed relation therewith, and a bypass pipe having an inlet end opening into the upper portion of said manifold and an outlet and opening into said heating air outlet means outwardly of said housing.

2. A heater including a firebox having an end panel, opposite side panels and top and bottom panels extending between said end and said opposite side panels with one end of said firebox being open, said firebox including depending support legs, an outer housing including opposite side and end walls and a top wall extending between said opposite side and end walls, said outer housing being downwardly telescoped over said firebox with one end wall sealingly secured over the open end of said firebox and said other end wall, top wall and opposite side walls spaced outwardly from said end panel, top panel and opposite side panels, respectively, and with the lower marginal edges of said opposite side and end walls generally horizontally registered with the lower ends of said legs, grate means in said firebox above said bottom panel, said front wall having a fuel door opening formed therein above said grate means and a draft door opening formed therein below said grate means and above said bottom panel, a flue outlet pipe opening outwardly from said firebox above said grate means and through one of said walls other than said front wall, said outer housing including heating air inlet and outlet means opening thereinto and outwardly therefrom, respectively, air pump means operative to effect the passage of air to be heated inwardly through said air inlet, through said housing about said firebox and outwardly through said outlet means, a downwardly opening and hollow pre-heating air chamber secured over said top wall, said air inlet including an air inlet opening downwardly through said pre-heating air chamber into the interior thereof and a pre-heated air conduit opening outwardly from said pre-heating air chamber and into said air pump means, said flue outlet pipe opens upwardly through said top wall, said top wall having an opening formed therethrough upwardly through which said outlet pipe is loosely received, an upstanding tubular manifold having its lower end sealingly secured to said top wall about said top wall opening, the upper end of said tubular manifold including a closure wall upwardly through which said flue outlet pipe extends in sealed relation therewith, and a bypass pipe having an inlet end opening into the upper portion of said manifold and an outlet end opening into said heating air outlet means outwardly of said housing.

3. The combination of claim 2 wherein said housing includes a draft door shiftable into and out of position closing said draft door opening, an electrically actuated solenoid, an electric motor driving said air pump means, and a thermostat for simultaneously electrically actuating said solenoid to shift said draft door to an open position and said electric motor for effecting operation of said air pump means.

* * * * *